US008517179B2

(12) United States Patent
Robertson et al.

(10) Patent No.: US 8,517,179 B2
(45) Date of Patent: Aug. 27, 2013

(54) VIBRATORY SEPARATOR SCREEN ATTACHMENT

(75) Inventors: Graham Robertson, Edinburgh (GB); Brian S. Carr, Burlington, KY (US); Eric Cady, Florence, KY (US); Claire Galloway, East Lothian (GB)

(73) Assignees: M-I L.L.C., Houston, TX (US); United Wire Limited, Edinburgh (GB)

( * ) Notice: Subject to any disclaimer, the term of this patent is extended or adjusted under 35 U.S.C. 154(b) by 226 days.

(21) Appl. No.: 12/681,048

(22) PCT Filed: Sep. 30, 2008

(86) PCT No.: PCT/US2008/078301

§ 371 (c)(1),
(2), (4) Date: Mar. 31, 2010

(87) PCT Pub. No.: WO2009/046018

PCT Pub. Date: Apr. 9, 2009

(65) Prior Publication Data

US 2010/0270215 A1 Oct. 28, 2010

Related U.S. Application Data

(60) Provisional application No. 60/977,891, filed on Oct. 5, 2007.

(51) Int. Cl.
*B07B 1/49* (2006.01)

(52) U.S. Cl.
USPC ..... 209/363; 209/392; 209/395; 209/405; 209/412

(58) Field of Classification Search
USPC ..... 209/363, 392, 395, 405, 412
See application file for complete search history.

(56) References Cited

U.S. PATENT DOCUMENTS

| | | | | |
|---|---|---|---|---|
| RE35,691 | E * | 12/1997 | Theirl et al. | 359/609 |
| 6,675,975 | B1 * | 1/2004 | Cook et al. | 210/490 |
| 2004/0149632 | A1 * | 8/2004 | Schulte et al. | 209/405 |
| 2010/0270215 | A1 * | 10/2010 | Robertson et al. | 209/363 |

FOREIGN PATENT DOCUMENTS

| | | | |
|---|---|---|---|
| CH | 385 461 | A | 12/1964 |
| EP | 1 417 993 | A1 | 5/2004 |
| EP | 1417993 | A1 * | 5/2004 |
| FR | 1 221 579 | A | 6/1960 |
| GB | 1 289 537 | A | 9/1972 |

OTHER PUBLICATIONS

International Search Report from PCT/US2008/078301 dated Mar. 3, 2009 (5 pages).

(Continued)

*Primary Examiner* — Terrell Matthews
(74) *Attorney, Agent, or Firm* — Osha Liang LLP

(57) ABSTRACT

A vibratory separator including a screen frame and a screen attachment. The screen attachment including at least one vertically disposed latch on the screen frame, at least one vertically disposed catch on the screen frame, and at least one bearing surface proximate the at least one vertically disposed catch. Additionally, a method of securing adjacent screens including inserting a vertically disposed latch of a first screen into a catch of a second screen, wherein the inserting includes contacting the latch of the first screen with a bearing surface of the second screen adjacent the catch of the second screen. The method further includes forming a planar alignment of the first screen to the second screen.

12 Claims, 5 Drawing Sheets

(56) References Cited

OTHER PUBLICATIONS

Written Opinion from PCT/US2008/078301 dated Mar. 3, 2009 (6 pages).
Examination Report issued in corresponding Canadian Patent Application No. 2,701,729; Dated Jul. 26, 2011 (2 pages).
Office Action issued in corresponding European Patent Application No. 08 836 086.2; Dated Nov. 15, 2010 (4 pages).
Office Action issued in corresponding Chinese Application No. 200880110325.8; Dated Mar. 4, 2013 (11 pages).
Office Action issued in corresponding Chinese Application No. 200880110325.8; Dated May 22, 2012 (11 pages).
Office Action issued in corresponding Canadian Application No. 2,701,729; Dated May 28, 2012 (2 pages).

* cited by examiner

VIBRATORY SEPARATOR SCREEN ATTACHMENT

BACKGROUND

1. Field of the Disclosure

Embodiments disclosed herein relate generally to vibratory separator screen attachments. More specifically, embodiments disclosed herein relate to apparatuses and methods for joining adjacent vibratory separator screens disposed in a vibratory separator.

2. Background Art

Oilfield drilling fluid, often called "mud," serves multiple purposes in the industry. Among its many functions, the drilling mud acts as a lubricant to cool rotary drill bits and facilitate faster cutting rates. Typically, the mud is mixed at the surface and pumped downhole at high pressure to the drill bit through a bore of the drillstring. Once the mud reaches the drill bit, it exits through various nozzles and ports where it lubricates and cools the drill bit. After exiting through the nozzles, the "spent" fluid returns to the surface through an annulus formed between the drillstring and the drilled wellbore.

Furthermore, drilling mud provides a column of hydrostatic pressure, or head, to prevent "blow out" of the well being drilled. This hydrostatic pressure offsets formation pressures, thereby preventing fluids from blowing out if pressurized deposits in the formation are breeched. Two factors contributing to the hydrostatic pressure of the drilling mud column are the height (or depth) of the column (i.e., the vertical distance from the surface to the bottom of the wellbore) and the density (or its inverse, specific gravity) of the fluid used. Depending on the type and construction of the formation to be drilled, various weighting and lubrication agents are mixed into the drilling mud to obtain the right mixture. Typically, drilling mud weight is reported in "pounds," short for pounds per gallon. Generally, increasing the amount of weighting agent solute dissolved in the mud base will create a heavier drilling mud. Drilling mud that is too light may not protect the formation from blow outs, and drilling mud that is too heavy may over invade the formation. Therefore, much time and consideration is spent to ensure the mud mixture is optimal. Because the mud evaluation and mixture process is time consuming and expensive, drillers and service companies prefer to reclaim the returned drilling mud and recycle it for continued use.

An additional purpose of the drilling mud is to carry the cuttings away from the drill bit at the bottom of the borehole to the surface. As a drill bit pulverizes or scrapes the rock formation at the bottom of the borehole, small pieces of solid material are left behind. The drilling fluid exiting the nozzles at the bit acts to stir-up and carry the solid particles of rock and formation to the surface within the annulus between the drillstring and the borehole. Therefore, the fluid exiting the borehole from the annulus is a slurry of formation cuttings in drilling mud. Before the mud can be recycled and re-pumped down through nozzles of the drill bit, the cutting particulates must be removed.

Apparatus in use today to remove cuttings and other solid particulates from drilling fluid are commonly referred to in the industry as "shale shakers." A shale shaker, also known as a vibratory separator, is a vibrating sieve-like table upon which returning solids laden drilling fluid is deposited and through which clean drilling fluid emerges. Typically, the shale shaker is an angled table with a generally perforated filter screen bottom. Returning drilling fluid is deposited at the feed end of the shale shaker. As the drilling fluid travels down length of the vibrating table, the fluid falls through the perforations to a reservoir below leaving the solid particulate material behind. The vibrating action of the shale shaker table conveys solid particles left behind until they fall off the discharge end of the shaker table.

The above described apparatus is illustrative of one type of shale shaker known to those of ordinary skill in the art. In alternate shale shakers, the top edge of the shaker may be relatively closer to the ground than the lower end. In such shale shakers, the angle of inclination may require the movement of particulates in a generally upward direction. In still other shale shakers, the table may not be angled, thus the vibrating action of the shaker alone may enable particle/fluid separation. Regardless, table inclination and/or design variations of existing shale shakers should not be considered a limitation of the present disclosure.

A vibratory separator, as described above, will generally have several perforated filter screens, across which solids travel and through which separated fluids pass. During normal use, screens and/or filtering elements on the screens may need to be replaced and/or repaired. Typically, the replacement and repair of screens require removing each screen individually, which can be both labor intensive and inefficient.

Accordingly, there exists a need for a screen attachment such that multiple screens may be locked together in vibratory separators.

SUMMARY OF THE DISCLOSURE

In one aspect, embodiments disclosed herein relate to a screen for a vibratory separator including a screen frame and a screen attachment. The screen attachment including at least one vertically disposed latch on the screen frame, at least one vertically disposed catch on the screen frame, and at least one bearing surface proximate the at least one vertically disposed catch.

In another aspect, embodiments disclosed herein relate to a method of securing adjacent screens including inserting a vertically disposed latch of a first screen into a catch of a second screen, wherein the inserting includes contacting the latch of the first screen with a bearing surface of the second screen adjacent the catch of the second screen. The method further includes forming a planar alignment of the first screen to the second screen.

In another aspect, embodiments disclosed herein relate to a method of arranging vibratory separator screens including placing a first screen having a first vertically disposed latch into a vibratory separator. The method further includes placing a second screen having a vertically disposed catch into the vibratory separator and forming a force-transmitting connection, wherein the forming includes engaging the first vertically disposed latch to the first vertically disposed catch.

Other aspects and advantages of the invention will be apparent from the following description and the appended claims.

DETAILED DESCRIPTION

In one aspect, embodiments disclosed herein relate to screens used on vibratory separators. In other aspects, embodiments disclosed herein relate to vibratory separator screen attachments. In still other aspects, embodiments disclosed herein relate to apparatuses and methods used to attach multiple screens for use with oilfield vibratory separators.

Figure 1:
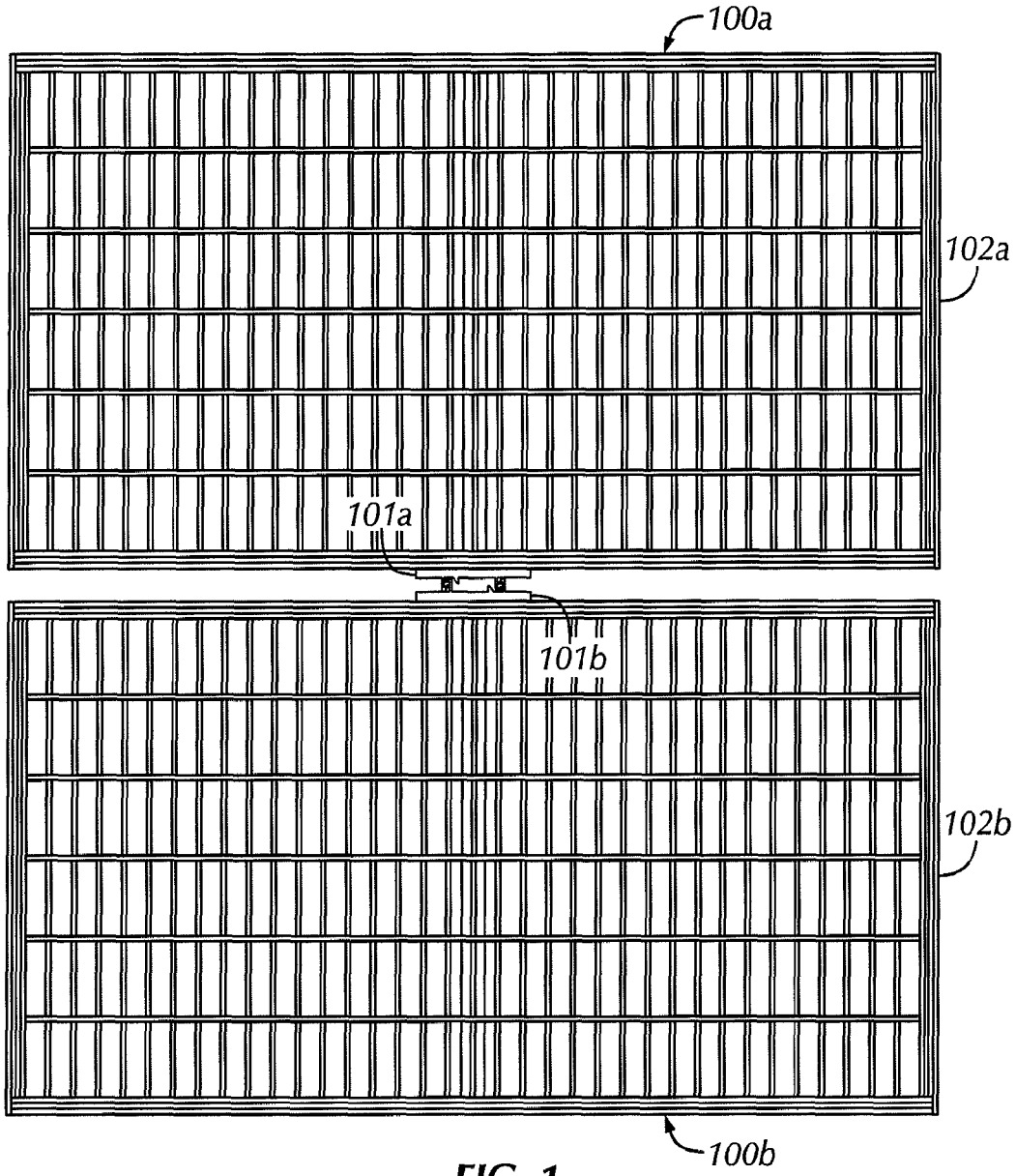
FIG. 1 is a plan view of a vibratory separator screen according to one embodiment of the present disclosure.

Referring to FIG. 1, a top view of two adjacent vibratory separator screens 100 according to one embodiment of the present disclosure is shown. Screens 100 include screen frames 102 and generally include filtering elements (not shown), which are disposed on screen frames 102. In this embodiment, a first screen 100*a* and a second screen 100*b* are illustrated disposed adjacent one another and attached via coupling of a first screen attachment 101*a* with a second screen attachment 101*b*. Screen attachments 101, as illustrated, are disposed on screen frames 102, such that when installed in a vibratory separator (not shown), the screen attachments form a force-transmitting connection.

Figure 2:
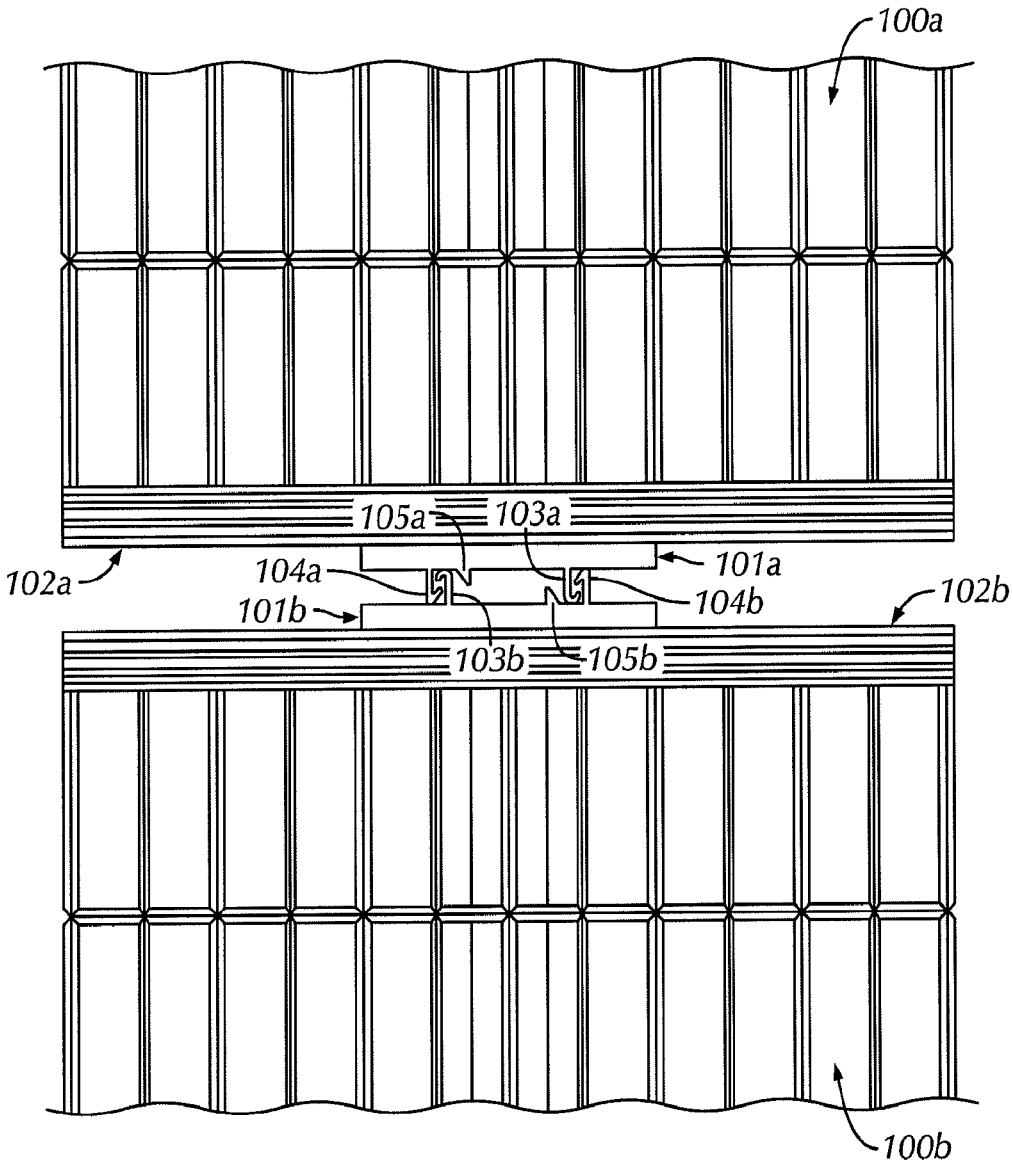
FIG. 2 is a top view of a vibratory separator screen attachment according to one embodiment of the present disclosure.

Referring to FIG. 2, a top view of the vibratory separator screens 100 from FIG. 1 is shown. As illustrated in close perspective, separator screens 100*a* and 100*b* also include corresponding frames 102*a* and 102*b*, as well as screen attachments 101*a* and 101*b*. Screen attachments 101*a* and 101*b* further include a vertically disposed latches 103*a* and 103*b* and vertically disposed catches 104*a* and 104*b*. Additionally, screen attachments 101*a* and 101*b* include bearing surfaces 105*a* and 105*b* proximate respective catches 104*a* and 104*b*.

As disclosed herein, latches 103, catches 104, and other components of screen attachments 101 disposed vertically refers to the orientation of the individual components, not the placement of the components on screens 100. Latches 103, catches 104, and the other components disclosed herein are illustrated on the side of screens 100. However, those of ordinary skill in the art will appreciate that in other embodiments, latches 103, catches 104, and other components may be disposed in vertical orientation on a top surface, bottom surface, or partially on a top surface, bottom surface, or side of screens 102.

As illustrated, during connection, vertically disposed latches 103 are inserted into vertically disposed catches 104, such that latches 103 are held in place between catches 104 and bearing surfaces 105. During insertion, latches 103 may contact bearing surfaces 105, such that latches 103 are directed to form a proper connection with catches 104. In this embodiment, screen 100*a* includes both latch 103*a* and catch 104*a*, which correspond to catch 104*b* and latch 103*b* of screen 100*b*. However, in other embodiments, those of ordinary skill in the art will appreciate that a screen 100 could be configured to include multiple latches 103, catches 104, and bearing surfaces 105. Furthermore, a screen may include only latches 103 or only catches 104 and bearing surfaces 105. As such, screen attachments 101 may include varied combinations of latches 103, catches 104, and bearing surfaces 105, so as to form a connection applicable to a specific separatory operation.

Components of screen attachments 101 may be formed from a number of materials used in forming screen attachment mechanisms known to those of ordinary skill in the art. Examples of materials that may be used include steel, polypropylene, or other plastics. In one embodiment, screen attachment 101 may be formed as an integral part of frame 102. In such an embodiment, screen attachment 101 may be formed from, for example, 20% glass reinforced polypropylene. Such a composition may provide a rigid screen attachment 101 that retains a required plasticity to contact bearing surface 105 and retain in catch 104.

To further enhance the connectivity of screen attachments 101, those of skill in the art will appreciate that components of screen attachments 101 may be coated to further enhance the connective attributes established thereby. For example, in certain embodiments, components of screen attachments 101 may be coated with polytetrafluoroethylene, fluorinated ethylene-propylene, perfluoroalkoxy polymer, or other coatings that provide low friction non-reactive properties to screen attachments 101. Such coatings may enhance the life of screen attachment 101 and/or provide for a better connection between latches 103 and catches 104. Such coatings may be of particular use if screen attachments 101 are composed of metals. However, those of skill in the art will appreciate that screen attachments 101 formed from polypropylene may not require additional coatings.

In certain embodiments, screen attachments 101 may be formed as an integral part of frames 102. However, in other embodiments, screen attachments 101 may be formed separate from frames 102, and later attached thereto. For example, screen attachments 101 may be mechanically fastened or chemically bonded to frames 102 after frames 102 have been formed. As such, those of ordinary skill in the art will appreciate that frames 102 may be formed from different materials than screen attachments 101. In still other embodiments, screen attachments 101 may be formed first, and then frame 102 may be molded around screen attachment 101. In such an embodiment, frame 102 may be formed around screen attachment 101 through, for example, injection molding. Additionally, because screen attachments 101 may be formed independent from frames 102, screen attachments 101 may be selectively installed on frames 102, or may be retrofitted to existing frames 102. Furthermore, screen attachments 101 may be selectively configured to frames 102 as vibratory operations require.

Still referring to FIG. 2, both latches 103 and catches 104 are vertically oriented with respect to frames 102. Such vertical orientation allows an operator to slide a screen 100*b* into a vibratory separator (not shown), such that latch 103*b* self-aligns with catch 104*a*. Bearing surface 105*a* may further provide a contact portion to direct latch 103*b* into catch 104*a*, should screen 100*b* be inserted at an inappropriate angle.

In addition to providing a self-aligning feature, vertically oriented screen attachments 101 are configured to prevent the retention of solids from interfering with the screen connection. For example, as solids pass over screens 100, solid particles may pass over screen attachment 101. Screen attachments 102, disposed to connect in horizontal orientation, allow solid particles from drilling waste to block the connection of latches 103 to catches 104. However, vertically orientated components allow solid particles to pass through screen attachment 102, thereby reducing interference therefrom. Additionally, should solid particles come in contact with screen attachment components, the vertical orientation of the components combined with the motion of the vibratory separator may prevent the solid particles from becoming lodged in place.

Figure 3:
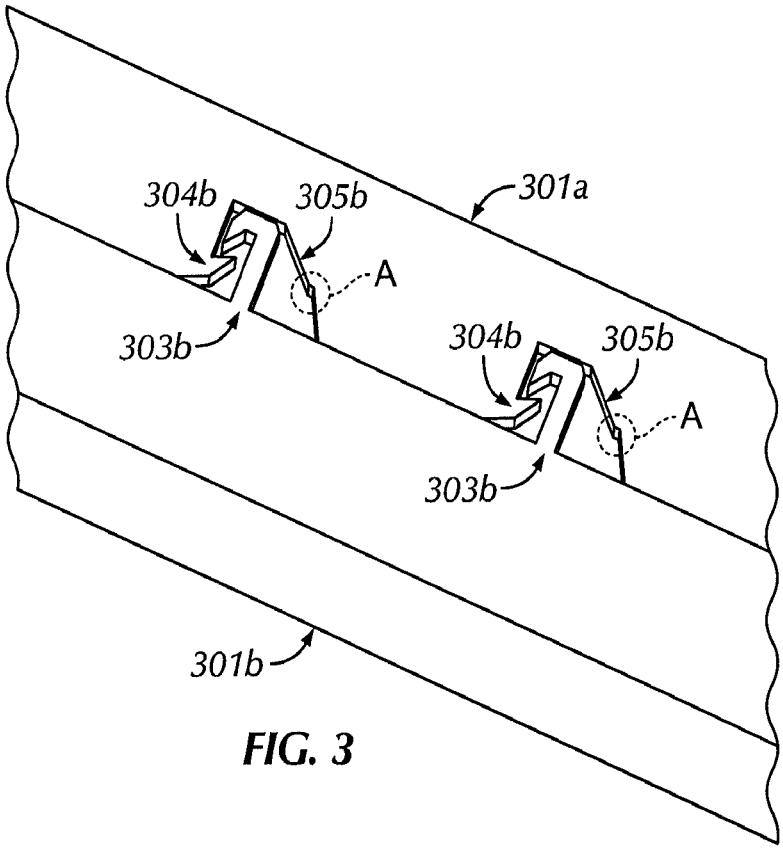
FIG. 3 is a perspective view of a screen attachment according to one embodiment of the present disclosure.

Referring to FIG. 3, a close perspective of a connection of two screens in accordance with embodiments of the present disclosure is shown. In this embodiment, screen attachments 301 include a first catch 304*a* corresponding to a first latch 303*a* and a second catch 304*b* corresponding to a second latch 303*b*. As illustrated, screen attachment 301*a* also includes a first bearing surface 305*a* and a second bearing surface 305*b*. In this embodiment, bearing surfaces 305 have a specialized profile, which includes a portion A. Aspects of the specialized profile may act as secondary or tertiary bearing surfaces, such that when latches 303 are inserted therein, the latches 303 contact multiple portions of bearing surfaces 305.

Those of ordinary skill in the art will appreciate that the specific geometry of bearing surfaces 305 may be varied to incorporate an optimized design for a particular attachment mechanism. In certain embodiments, bearing surfaces 305 may include angled, orthogonal, linear, triangular, conical, or other geometric shapes/profiles. Additionally, bearing surfaces 305 may include profiles formed from specialized materials. In certain embodiments, it may be beneficial to increase the wear resistance, decrease friction during engagement, improve resistance to drill fluids, or otherwise improve other characteristics of bearing surfaces 305. In such embodiments, it may be beneficial to coat or form bearing surfaces from specialized materials. Exemplary materials include polytetrafluoroethylene, or other materials that may enhance the properties of bearing surfaces 305.

During use, those of ordinary skill in the art will appreciate that latches 303 may not continuously contact catches 304. Rather, latches 303 may only contact catches 304 when an operator removes the screens from the vibratory separator (as illustrated in FIG. 3). Such a configuration may thereby further decrease the wear on components of screen attachments 301. However, in other embodiments, latches 303 may be in substantially continuous contact with catches 304, such that motion of the screens in a lateral direction is restricted. Such a configuration may be beneficial in imparting consistent motion to all screens in the vibratory separator. Additionally, such a configuration may help prevent solid particles from falling between the screens.

Still referring to FIG. 3, as illustrated, a screen attachment 301*a* may be configured to include two catches 304*a* and 304*b*, while a second screen attachment 301*b* is configured to include two latches 303*a* and 303*b*. With such a design, a single screen (not individually illustrated) may include a first side having multiple catches 304 and a second side having multiple latches 303. In other embodiments, a screen attachment 301 of a screen (not individually illustrated) may include both a catch 304 and a latch 303, a plurality of catches 304 and latches 303, or any other combination of both catches 304 and latches 303. Those of ordinary skill in the art will appreciate that certain configurations of catches 304 and latches 303 may be preferable. For example, a screen having a screen attachment 301 including both a catch 304 and a latch 303 on each side may be substantially interchangeable, such that a drilling operator would not have to be concerned with ordering screens having attachments of appropriate configuration. However, other configurations may also allow for interchangeability, such as screens having only catches 304 on a first side, and only latches 303 on a second side. Those of ordinary skill in the art will appreciate that a number of configurations may be achieved by adjusting the number of screen attachment components, the placement of the components, and design variables of the individual components.

Figure 4A:
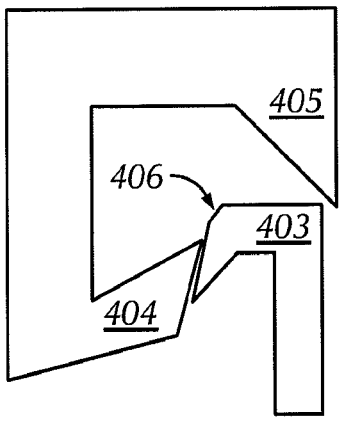
FIGS. 4*a*-4*c* show an operational sequence of connecting screens according to one embodiment of the present disclosure.
Figure 4B:
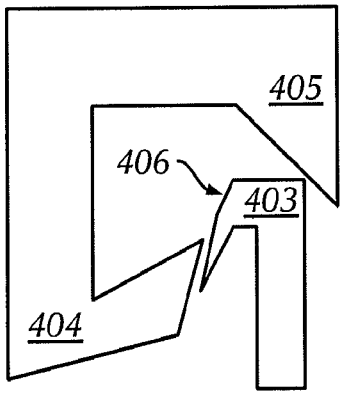
Figure 4C:
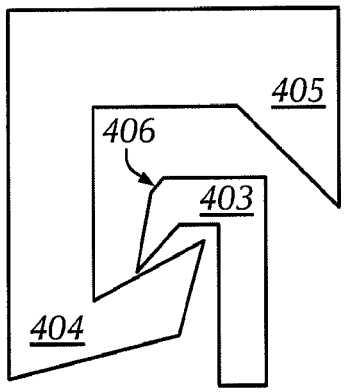

Referring to FIGS. 4*a*, 4*b*, and 4*c*, an operational sequence of inserting a latch 403 into a catch 404 according to embodiments of the present disclose is shown. For clarity, like numbers in FIGS. 4*a*-4*c* represent like components. In this embodiment, latch 403 is inserted such that a distal end 406 of latch 403 contacts catch 404 (at FIG. 4*a*). As latch 403 is inserted further (at FIG. 4*b*), contact with both catch 404 and bearing surface 405 causes latch 403 to elastically deform. Such deformation may thereby allow bearing surface 405 to guide latch 403 over catch 404, thereby deflecting latch 403 into a locked orientation (at FIG. 4*c*). Such a configuration may allow latch 403 to engage an attachment component of a screen by springing into place, thereby locking two screens together.

Those of ordinary skill in the art will appreciate that embodiments including latches 403 that elastically deform during engagement with catch 404 may provide particularly secure connections. However, in certain embodiments, more rigid connections may be desired. During manufacture, the type of latch 403 used for a specific screen attachment may thus be varied according to any number of design considerations, such as, for example, the type of solids/fluid being processed, the wear rate of the screens, the type of motion used, the number of anticipated screen changes, etc.

Generally, during use, an operator will insert a vertically disposed latch of a first screen into a catch of a second screen. The inserting includes contacting the latch of the first screen with a bearing surface of the second screen, thereby providing planar alignment of the first screen to the second screen. After the screen is inserted, a force-transmitting connection is formed, such that the connection allows the first screen and the second screen to be moved together (i.e., to allow the screens to slide in and/or out of a vibratory separator). Thus, during screen changes, rather than remove multiple screens one at a time, an operator may simply remove the first screen, and because the screens are held together, all of the screens may be removed simultaneously. Such a configuration may provide for more efficient screen changes, resulting in less downtime of the vibratory separator.

In certain embodiments, the screens may be held together, but still removed individually from the vibratory separator. In such an embodiment, as the first screen is pulled out of the vibratory separator the second screens slides toward the removal end. The operator may disengage the two screens, remove the first screen, then subsequently remove the second screen. In this aspect, the screens may more easily be removed from the separator because the screens remain engaged until the first screen is removed from the vibratory separator. Those of ordinary skill in the art will appreciate that more than two screens may also be slid together. For example, in alternate embodiments, three, four, or even more screens may be engaged during operation of the vibratory separator, and then removed according to the methods detailed above.

Once the screens have been removed from the vibratory separator, the operator may separate the screens by, for example, angling one of the screens to allow the latch to slide out from the catch. Alternatively, the operator may slide one of the screens in a vertical plane (e.g., up or down) such that the latch may be removed from the catch. The later method of disengaging the screens may be preferable in embodiments having elastically deformable latches or catches. In still other embodiments, the operator may slide one of the screens in a horizontal plane (e.g., side-to-side) such that the latch may be removed from the catch. Those of ordinary skill in the art will appreciate that depending on the specific design of the interface between the catches and latches, motion in vertical, horizontal, or combinations thereof may be used to disengage the screens.

Those of ordinary skill in the art will further appreciate that bearing surfaces of the screen attachments may provide for the alignment of screens during insertion into the vibratory separator. Thus, by moving a latch against a bearing surface of an opposing screen, the first screen and the second screen may be aligned within the vibratory separator. Additionally, because the screens may be aligned within the separator, the operator may be able to move multiple screens in unison, such that the screens may be moved into an optimal placement.

Other embodiments of the present disclosure may include screens having a screen attachment on a first side of the screen and no screen attachment on a second side of the screen. Such a configuration may be used as a back screen or a front screen (i.e., the screen first inserted or last inserted into a vibratory separator). Such back or front screens may further include a softer sealing material on the side of the screen not having a screen attachment to seal the screen against a side of the separator. Those of ordinary skill in the art will appreciate that screen attachments, such as disclosed herein, may be included on one side, two sides, three sides, or all sides of the vibratory separator screen.

In still other embodiments, screen attachments may further include a seal. The seal may be placed on a top side of the screen, spatially oriented above the catches and/or latches. In such an embodiment, the seal may prevent the drilling fluids and solid particles from contacting the screen attachment components, thereby extending the life of the components. Additionally, a seal may further enhance the efficiency of the separatory operation by preventing drilling fluids and solid particles from passing between the screens (i.e., bypassing the screens without being filtered). Those of ordinary skill in the art will appreciate that exemplary seals may be formed from rubbers, plastics, thermoplastic elastomers ("TPE"), foams, polychloroprene, polypropylene, nylon, mylar, composites, and/or any combinations thereof. Furthermore, such sealing elements may extend to cover substantially all of or just a portion of the attachment components. Thus, in certain embodiments, at least one seal of opposing screens may interface to cover substantially all of opposing screen attachment components.

Figure 5A:
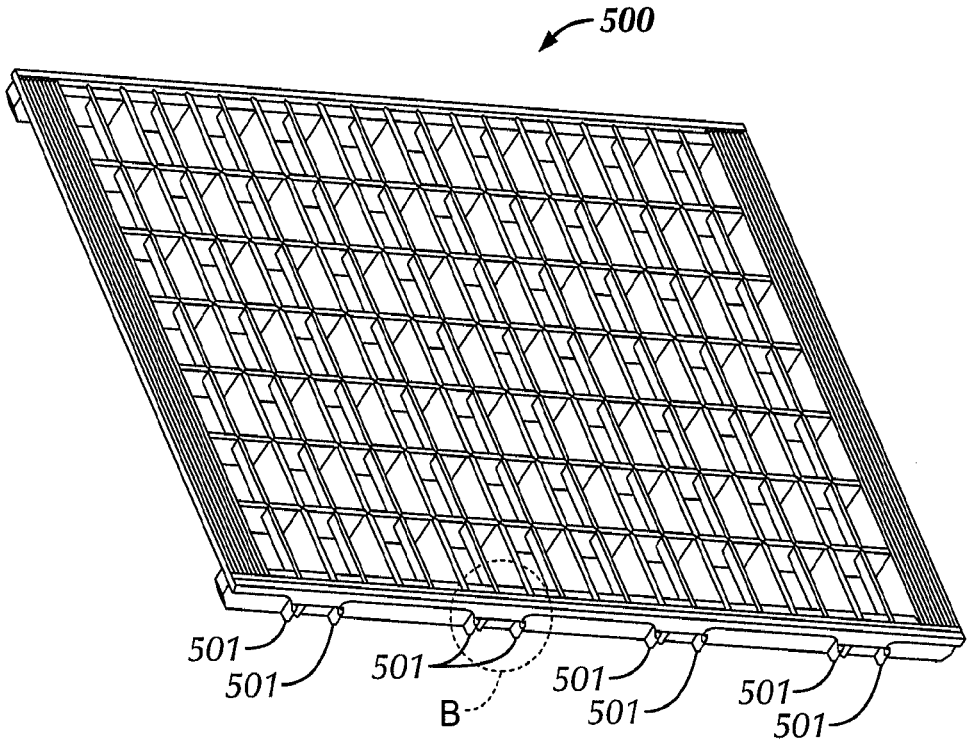
FIG. 5A is a perspective view of a vibratory separator screen according to one embodiment of the present disclosure.
Figure 5B:
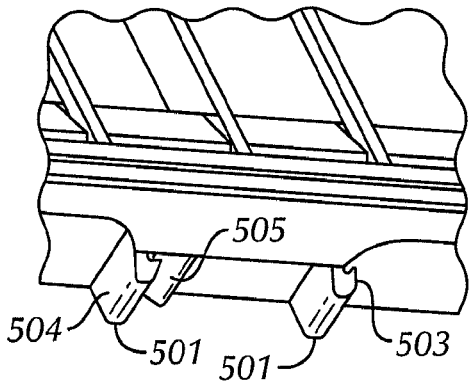
FIG. 5B is a close perspective view of Section B of FIG. 5A according to one embodiment of the present disclosure.

Referring to FIGS. 5A and 5B together, a perspective view (FIG. 5A) and a close perspective view (FIG. 5B, represented as Section B of FIG. 5A) of a screen 500 according to an embodiment of the present disclosure is shown. In this embodiment, screen 500 includes a plurality of screen attachments 501. Screen attachments 501 include a latch 503, a catch 504, and a bearing surface 505. In this embodiment, bearing surface 505 is recessed into the screen frame. By recessing bearing surface 505 into the screen frame, as solid particles pass over the screen 500 during use, the likelihood of solid particles becoming trapped between components of screen attachment 501 may be decreased. To further decrease the trapping potential of screen attachment components, a seal (not illustrated) may be affixed to the screen frame, as described above.

Additionally, screen 500 only includes screen attachments 501 one side of the screen frame. Such an embodiment may be used as a screen that is inserted into a vibratory separator as either the first screen or last screen. Because one side of the vibratory separator does not include screen attachments 501, the side without screen attachments 501 may better seal against an end of the vibratory separator. In other embodiments, screen 500 may be designed to include screen attachments 501 on two or more sides of screen 500. In such embodiments, the vibratory separator may include attachment components that correspond to screen attachments 501, thereby further securing screen 500 in place during operation.

Advantageously, embodiments of the present disclosure may provide for screens for vibratory separators that allow for more efficient screen changes. Because the screen attachments of the present disclosure may allow an operator to remove multiple screens from a separator at the same time, the operator may be able to complete a screen change in less time. By decreasing the time required for screen changes, the downtime of a vibratory shaker may also be decreased, thereby allowing a greater of volume of drilling waste to be processed.

Also advantageously, embodiments of the present disclosure may provide for a screen attachment mechanism that is less likely to fail during operation. Previously, horizontally opposed screen attachments would be disengaged due to lodged solid particles between the individual attachment components. Because the latches and catches of the present screen attachments are vertically oriented, drilling waste that falls between screens may not get lodged between the individual screen attachment components, thereby retaining screen engagement.

Moreover, screens designed in accordance with the embodiments disclosed herein may include self-aligning features, further enhancing the separating efficiency of the vibratory operation. Because bearing surfaces of the present disclosure may provide for attachments that are locked together at an optimal orientation, less drilling waste may bypass the screens, thereby increasing the efficiency of the separatory process.

Finally, embodiments of the present disclosure may incorporate screen attachment components that are configured such that a screen may be installed in a vibratory separator with either side of the screen being inserted first. As such, screens may be placed into a vibratory separator without regard to which end is being inserted first. Such design considerations may further expedite screen changes, thereby further increasing the efficiency of the vibratory operation.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A method of securing adjacent screens comprising:

inserting a vertically disposed latch of a first screen into a vertically disposed catch of a second screen, wherein the inserting comprises:

contacting the vertically disposed latch of the first screen with a bearing surface of the second screen adjacent the vertically disposed catch of the second screen; and forming a planar alignment of the first screen to the second screen, wherein the inserting further comprises elastically deforming the latch.

2. The method of claim 1, wherein the forming a planar alignment further comprises:

sealing at least a top surface of the first and second screens at an interface of the frames.

3. The method of claim 1, further comprising:

forming a force-transmitting connection, wherein the connection allows the first screen and the second screen to slide out of a vibratory separator in unison.

4. A method of arranging vibratory separator screens comprising:

placing a first screen having a first vertically disposed latch into a vibratory separator;

placing a second screen having a first vertically disposed catch into the vibratory separator; and forming a force-transmitting connection, wherein the forming comprises:

engaging the first vertically disposed latch to the first vertically disposed catch and elastically deforming the first vertically disposed latch.

5. The method of claim 4, further comprising:

aligning the first screen with the second screen by moving the first disposed latch against a bearing surface of the second screen.

6. The method of claim 5, wherein the engaging comprises:

sliding the second screen into planar alignment with the first screen.

7. The method of claim 6, further comprising:

moving the first screen and the second screen into operable placement in the vibratory separator.

8. The method of claim 6, further comprising:

removing the first screen from the vibratory separator, wherein the movement of the first screen causes movement of the second screen.

9. The method of claim 8, wherein the removing comprises sliding.

10. The method of claim 8, further comprising:

disengaging the first screen from the second screen.

11. The method of claim 10, wherein the disengaging comprises:

turning the first screen at an angle relative to the second screen, wherein the first vertically disposed latch disengages the first vertically disposed catch.

12. The method of claim 4, wherein the first screen has a second vertically disposed catch, and the second screen has a second vertically disposed latch.

* * * * *

UNITED STATES PATENT AND TRADEMARK OFFICE

CERTIFICATE OF CORRECTION

PATENT NO. : 8,517,179 B2
APPLICATION NO. : 12/681048
DATED : August 27, 2013
INVENTOR(S) : Robertson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 347 days.

Signed and Sealed this
Seventh Day of April, 2015

Michelle K. Lee

Michelle K. Lee
*Director of the United States Patent and Trademark Office*